United States Patent [19]

Nakahama et al.

[11] Patent Number: 4,545,769

[45] Date of Patent: Oct. 8, 1985

[54] TILT LOCKING SYSTEM FOR BOAT PROPELLERS

[75] Inventors: Ryoji Nakahama, Iwata; Kenichi Handa, Hamamatsu, both of Japan

[73] Assignees: Yamaha Hatsudoki Kabushiki Kaisha; Sanshin Kogyo Kabushiki Kaisha, both of Japan

[21] Appl. No.: 492,745

[22] Filed: May 9, 1983

[30] Foreign Application Priority Data

Jun. 8, 1982 [JP] Japan ..... 57-96977

[51] Int. Cl.[4] ..... B63H 5/12

[52] U.S. Cl. ..... 440/61; 188/299; 188/318

[58] Field of Search ..... 440/61, 52; 91/401; 188/318, 299

[56] References Cited

U.S. PATENT DOCUMENTS

| | | | |
|---|---|---|---|
| Re. 27,932 | 2/1974 | Mettetal, Jr. | 440/61 |
| 3,186,375 | 6/1965 | Cass | 440/61 |
| 3,285,221 | 11/1966 | North | 440/61 |
| 3,434,448 | 3/1969 | Woodfill | 440/61 |
| 3,434,450 | 3/1969 | McCormick | 440/61 |
| 3,722,455 | 3/1973 | Carpenter | 440/61 |
| 3,799,104 | 3/1974 | Kurling | 440/61 |
| 3,839,986 | 10/1974 | Meyer et al. | 440/61 |
| 3,863,592 | 2/1975 | Borst | 440/61 |
| 3,885,517 | 5/1975 | Borst et al. | 440/61 |
| 3,888,203 | 6/1975 | Lohse | 440/61 |
| 3,983,835 | 10/1976 | Hall | 440/61 |
| 3,999,502 | 12/1976 | Meyer | 440/61 |
| 4,052,952 | 10/1977 | Hale et al. | 440/61 |
| 4,064,824 | 12/1977 | Hall et al. | 440/61 |
| 4,363,629 | 12/1982 | Hall et al. | 440/61 |

*Primary Examiner*—Jesus D. Sotelo
*Attorney, Agent, or Firm*—Ernest A. Beutler

[57] ABSTRACT

Two embodiments of hydraulic control systems for outboard drives that permit the motor to pop up when an underwater obstacle is struck and return to its normal condition once the obstacle is cleared under a controlled force. Each embodiment includes a simplified arrangement wherein the motor may be raised from a normal running condition to a shallow water trim position and will be held hydraulically in the shallow water position. Each embodiment also permits popping up of the motor from the shallow water position when an underwater obstacle is struck. In one embodiment, the motor is permitted to return to the shallow water position once the obstacle is cleared whereas in the other embodiment, the motor returns to its normal condition once the underwater obstacle is cleared.

16 Claims, 11 Drawing Figures

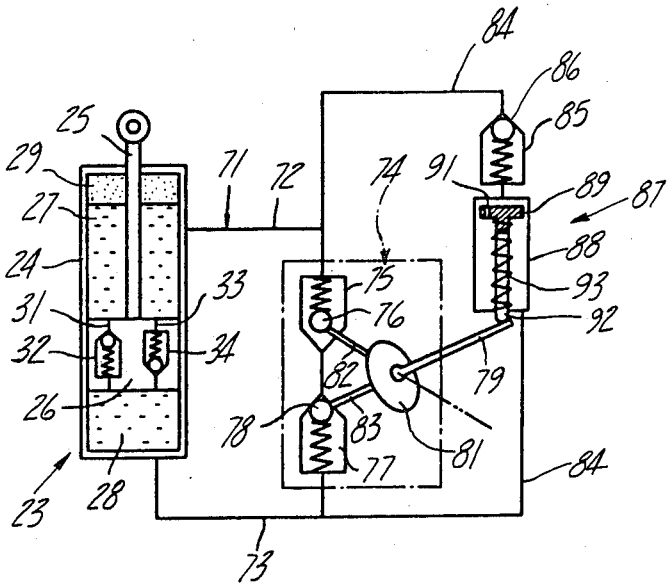
Fig-9
Fig-10
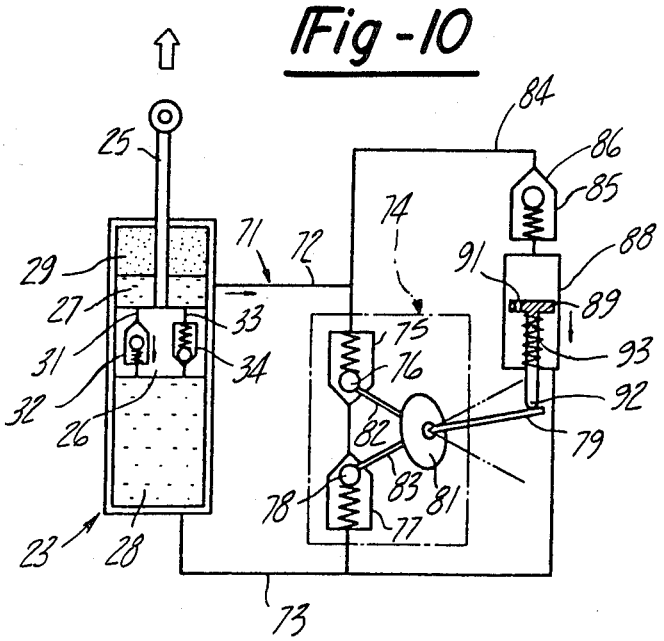

TILT LOCKING SYSTEM FOR BOAT PROPELLERS

BACKGROUND OF THE INVENTION

This invention relates to a tilt locking system for boat propellers and more particularly to an improved tilt locking and shock absorbing arrangement for a marine outboard drive.

It has been known in the mounting of marine outboard drives, such as the outboard drive unit of an inboard/outboard arrangement or in an outboard motor per se, to employ a hydraulic shock absorbing arrangement between the outboard drive and the boat hull. The shock absorbing arrangement normally is operative to permit the outboard drive to pop up when an underwater obstacle is struck and to gradually return to its normal trim position. Frequently, however, it is desirable to adjust the trim angle of the outboard drive so as to permit operation is shallow water without interference from the hydraulic arrangement. It is particularly desirable if the shock absorbing arrangement is also functional when the outboard drive is operated in its shallow trim position. That is, the arrangement should be such that the motor is permitted to pop up even when operating in its shallow water condition but will be returned to its operating position once the underwater obstacle has been passed. In my copending application, Ser. No. 481,315, filed Apr. 1, 1983, entitled "Tilt Locking System For Ship Propellers" and assigned to the assignee of this invention, there is disclosed an improved and simplified hydraulic arrangement that achieves these functions. Although the arrangement shown in that patent application achieves these functions, it requires the use of a plurality of hydraulic circuits that extend between the two chambers of the shock absorbing mechanism and which embody check valves, manually operated valves and time delay valves. Although effective, the system is therefore complicated, and accordingly, expensive and relatively large in size.

It is, therefore, a principal object of this invention to provide an improved tilt locking system for an outboard drive that permits the outboard drive to pop up and return from a normal trim condition or from a shallow trim condition.

It is a further object of this invention to provide an improved and simplified tilt locking mechanism of the type described.

In my aforedescribed patent application, the hydraulic circuit includes a first passage that extends from one chamber of the hydraulic mechanism to another chamber and that permits flow from the first chamber to the second chamber through a check valve and a manually operated valve. A second passage extends between the chambers and includes a second check valve and a second manually operated valve that permit flow selectively from the second chamber to the first chamber. Although such an arrangement permits the achievement of the functions set forth above, it is, as has also been noted, complicated.

It is, therefore, a still further object of this invention to provide a hydraulic circuitry for a tilt locking mechanism of an outboard drive wherein flow is selectively permitted between the chambers in either direction through a simplified and improved control mechanism.

SUMMARY OF THE INVENTION

A first feature of this invention is adapted to be embodied in a tilt locking and shock absorbing arrangement for a marine outboard trim comprising a drive member that is supported for tilting movement relative to the hull of the associated watercraft about a substantially horizontally disposed tilt axis. A hydraulic assembly is interposed between the drive member and the hull and includes a cylinder and piston slidably supported in the cylinder and defining first and second chambers. The hydraulic assembly is interrelated so that there will be relative movement between the piston and cylinder upon tilting movement of the drive member about its drive axis. First passage including pressure responsive absorber valve means permits flow from the first chamber to the second chamber upon the application of a predetermined force tending to cause the drive member to tilt up about the tilt axis. A second passage including pressure responsive relief valve means permits flow from the second chamber to the first chamber upon the exertion of a predetermined force to effect tilt down of the drive member. In accordance with this feature of the invention, means are provided for controlling the movement of the drive member about the tilt axis comprising a third passage that extends between the first and second chambers. First check valve means are interposed in the third passage for permitting flow from the first chamber to the second chamber and for precluding flow from the second chamber to the first chamber. Second check valve means are interposed in the third passage for permitting flow from the second chamber to the first chamber and for precluding flow from the first chamber to the second chamber through the third passage. Control means are incorporated for selectively opening one of the check valves so that the other check valve means will control the flow between the chambers.

Another feature of this invention is also adapted to be embodied in a tilt locking and shock absorbing arrangement for a marine outboard drive that includes a drive member and a hydraulic assembly interposed between the drive member and the hull for controlling the movement of the drive member relative to the hull as described in the preceding paragraph. In accordance with this feature of the invention, damping means permit flow from the first chamber to the second chamber upon the application of a predetermined force tending to cause the drive member to tilt up about the tilt axis and for permitting flow from the second chamber to the first chamber upon the exertion of a predetermined force to effect tilt down of the drive member. Passage means extend between the first and second chambers and first check valve means in the passage means permit flow from the first chamber to the second chamber and for precluding flow from the second chamber to the first chamber. Second check valve means in the passage means permit flow from the second chamber to the first chamber and preclude flow from the first chamber to the second chamber. Control means are selectively operative to open one of the check valve means so that the other check valve means controls the flow through the passage.

Yet another feature of the invention is adapted to be embodied in a hydraulic system that comprises a piston and cylinder assembly defining first and second fluid chambers. Means are provided for controlling the flow between the chambers upon relative movement between the piston and cylinder comprising passage means communicating the chambers with each other. Valve means selectively permit flow only from the first chamber to the second chamber through the passage means and permit flow only from the second chamber to the first chamber through the passage means. Means responsive to a predetermined pressure in the first chamber is effective to move the valve means from a position wherein the valve means is in a position so that there can be flow from the first chamber to the second chamber but not from the second chamber to the first chamber to a position wherein the valve means is moved so that there may be flow only from the second chamber to the first chamber.

BRIEF DESCRIPTION OF THE DRAWINGS

FIG. 3 shows the normal running condition;

FIG. 4 shows a popping up action from the normal running condition;

FIG. 5 shows return from the popped up condition to normal running;

FIG. 6 shows the arrangement for permitting manual tilting up of the outboard motor to a shallow drive condition;

FIG. 7 shows the operation and popping up from the shallow drive;

FIG. 8 shows return to the shallow drive from the popped up condition;

FIGS. 9 through 11 are partially schematic views showing another embodiment of the invention in various operating conditions:

FIG. 9 shows the arrangement in a condition where the motor is operating in a shallow trim condition;

FIG. 10 shows popping up from the shallow trim condition;

FIG. 11 shows return from the popped up condition.

DETAILED DESCRIPTION OF THE PREFERRED EMBODIMENTS OF THE INVENTION

The Environment

Figure 1:
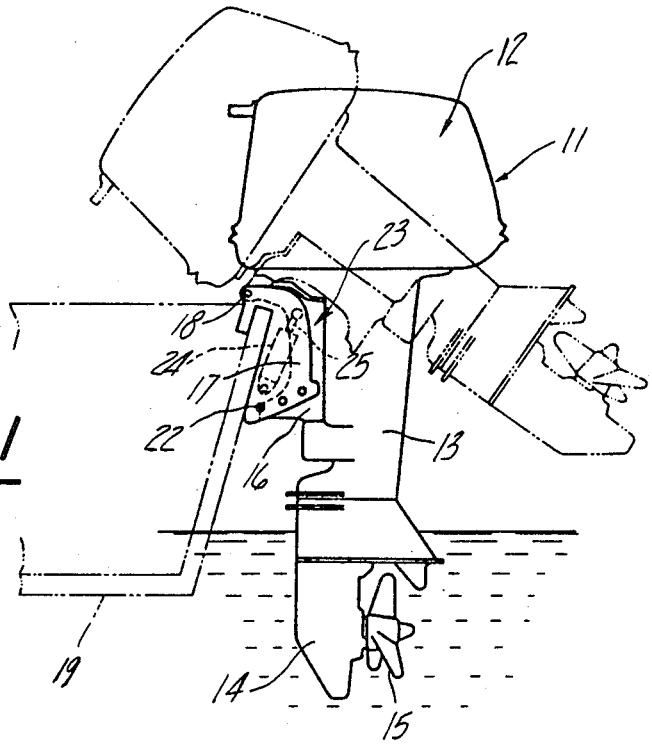
FIG. 1 is a side elevational view of an outboard motor and associated watercraft illustrating how the embodiments of the invention are employed. The motor is shown in a normal running condition in solid lines and in a tilted up condition in dot-dash lines.
Figure 2:
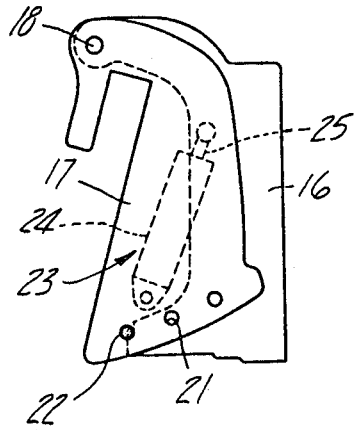
FIG. 2 is an enlarged, side elevational view of the mounting arrangement for the outboard motor and the tilt and trim control device.

An environment in which the embodiments of the invention may be employed as shown in FIGS. 1 and 2. The invention is adapted to be embodied in an outboard drive unit for a watercraft and in the illustrated embodiment this comprises an outboard motor, indicated generally by the reference numeral 11. It is to be understood, however, that the invention may also be used in conjunction with the outboard drive of an inboard/outboard arrangement.

The outboard motor 11 includes a power head 12, drive shaft housing 13 and lower unit 14 that supports a propeller 15. The internal construction of the motor 11 forms no part of this invention and therefore these details have not been illustrated nor will they are described in detail.

The drive shaft housing 13 is supported for steering movement about a generally vertically extending axis relative to a swivel bracket 16 in a known manner. The swivel bracket 16 is, in turn, pivotally connected to a clamping bracket 17 for tilting movement of the outboard motor 11 about a horizontally disposed tilt axis by means of a tilt pin 18. The clamping bracket 17 is, in turn, affixed to the transom of a watercraft, illustrated partially and shown in dot-dash lines 19.

The clamping bracket 17 is provided with a series of spaced apertures 21 in which a trim pin 22 may be selectively positioned. As is well known in this art, the swivel bracket 16 engages the trim pin 22 so as to set the normal trim adjustment of the motor 11 relative to the tilt pin 18. The structure thus far described is conventional and, for that reason, further description of the construction is not believed to be necessary for those skilled in the art to comprehend the invention.

A hydraulic assembly, indicated generally by the reference numeral 23 is interposed between the motor 11 and boat 19 for controlling the pivotal movement about the tilt pin 18. The hydraulic assembly includes a cylinder 24 and a piston, to be described, to which a piston rod 25 is affixed. As will become more apparent as this description proceeds, the piston associated with the piston rod 25 divides the cylinder 24 into a pair of spaced fluid chambers. A suitable circuitry, also to be described, is provided for controlling the flow between these chambers so as to control the position of the motor 11 and its relative movement about the tilt pin 18. The manner of connecting the elements of the hydraulic assembly 23 to the boat 19 and motor 11 may vary. In the illustrated embodiment, the cylinder assembly 24 is pivotally connected at its lower end to the clamping bracket 17 and the upper end of the piston rod 25 is pivotally connected to the swivel bracket 16. Various other types of connections may be employed, however, without departing from the invention.

EMBODIMENT OF FIGS. 3 THROUGH 5

Referring now primarily to FIGS. 3 through 8, the construction of the hydraulic control assembly 23 will be described in detail. The cylinder assembly 24 is provided with a cylinder bore in which a piston 26, as aforedescribed, is supported for reciprocation. The piston 26 divides the interior of the cylinder 24 into a first chamber 27, that is positioned on the upper side of the piston 26, and as second lower chamber 28. Hydraulic fluid of a suitable type is contained within the chamber 28 and a major portion of the chamber 27. A compressible gas of a suitable type fills a volume 29 in the chamber 27 above the normal liquid level therein. The gas 29 serves the function of compensating for the changes in volume within the chamber 27 caused by the piston rod 25 as is well known in this art.

The piston 26 is formed with a first passage 31 that extends between the chambers 27 and 28 in which a pressure responsive absorber valve 32 is positioned. The absorber valve 32 operates like a check valve and will permit flow from the chamber 27 to the chamber 28 when an underwater obstruction is struck so as to permit the motor 11 to pop up. The valve 32, however, precludes any flow from the chamber 28 through the passage 31 to the chamber 27.

A second passage 33 also extends through the piston 26 between the chambers 27 and 28. A pressure responsive relief valve 34 is positioned in the passage 33 so as to permit flow from the chamber 28 to the chamber 27 while precluding reverse flow. The relief valve 34 is designed so as to open under a predetermined pressure, as may be experienced when the motor is running in a shallow water position and more than a predetermined forward thrust is exerted, as will become apparent.

A bypass passage, indicated generally by the reference numeral 35, is provided for selectively communicating the chambers 27 and 28 with each other independently of flow through the piston passages 31 and 33. The bypass passage 35 includes a first branch 36 that communicates freely with the chamber 27 and a second branch 37 that communicates freely with the chamber 28. A manually operated directional control valve, indicated generally at 38, is provided for controlling the communication of the branch passages 36 and 37 with each other.

Figure 3:
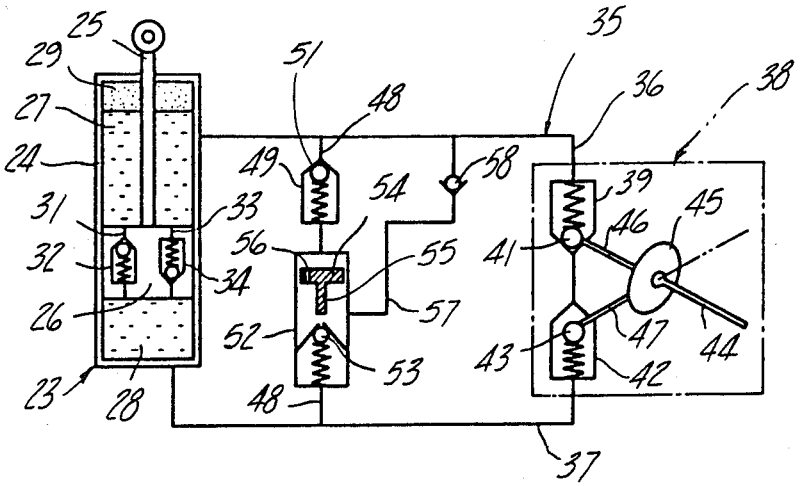
FIGS. 3 through 8 are partially schematic views showing a first embodiment of the invention in various conditions.

The directional control valve 38 includes a first check valve 39 having a ball 41 that is operative so as to permit flow from the branch passage 37 and chamber 28 to the branch passage 36 and chamber 27 when the ball 41 is unseated by appropriate pressure. An oppositely operating check valve 42 having a ball 43 also forms a part of the control valve 38. The check valve 42 permits flow from the passage 36 and chamber 27 to the branch passage 37 and chamber 28 when sufficient pressure is exerted to unseat the ball 43. A manually controlled operator 44 is provided for selectively unseating either the ball 41 associated with the check valve 39 or the ball 43 associated with the check valve 42. The manually controlled operator 44 is connected to a cam 45 that in turn operates either a rod 46 for unseating the ball 41 or a rod 47 for unseating the ball 43. FIG. 3 shows the condition of the mechanism and specifically the manually operated directional control valve 38 when operating normally in a non-shallow water condition.

A branch communication passageway 48 also extends between the branch passageways 36 and 37. A check valve 49 having a ball valve element 51 is provided in the branch passageway 48. The check valve 49 is designed so as to open when a predetermined pressure rise occurs in the chamber 27 so as to permit flow from the chamber 27 to the chamber 28 through the branch passageway 48. The pressure at which the check valve 49 opens is lower than the pressure required to open the absorber valve 32.

A time delay valve, indicated generally by the reference numeral 52, is provided in the branch communication passage 48 downstream of the check valve 49. The time delay valve 52 includes a ball check valve 53 that is disposed so as to permit flow through the branch communicating passage 48 from the chamber 27 to the chamber 28 while precluding reverse flow. A time delay piston 54 is positioned upstream of the check valve 53 and has a piston rod portion 55 that is adapted at times to engage the ball valve 53 and unseat it, as will become apparent. A restricted orifice 56 extends through the piston 54 for a reason to be described.

A passageway 57 extends from the time delay valve 52 upstream of the check valve ball 53 to the branch passageway 36. A check valve 58 is interposed in the passageway 57 and is disposed so as to permit flow from the time delay valve 52 to the branch passageway 36 and chamber 27 from the chamber 28 under circumstances to be described.

OPERATION OF EMBODIMENT OF FIGS. 3 THROUGH 8

As has been previously noted, FIG. 3 shows the condition of the hydraulic control device 23 when operating under normal conditions. The operator 44 and cam 45 are positioned so that the ball valve 41 of the check valve 39 can be urged to its seated position and the ball valve 43 of the check valve assembly 42 is held in an opened condition. Hence, the control valve 38 is set so that communication is permitted between the chamber 28 and the chamber 27 through the branch passages 37 and 36, when a predetermined pressure exists in the chamber 28 relative to the pressure in the chamber 27. That is, flow may occur from the chamber 28 through the branch passage 27 past the check valve 39 to the branch passage 36 and chamber 27. On the other hand, the check valve 39 will preclude any flow from the chamber 27 to the chamber 28 through the control valve 38.

When the boat is being driven in a forward direction, the thrust of the propeller 15 will cause the swivel bracket 16 to engage the trim adjusting pin 22 and hold the motor 11 against pivotal movement in a clockwise direction about the tilt pin 18 as viewed in FIG. 1.

Figure 4:
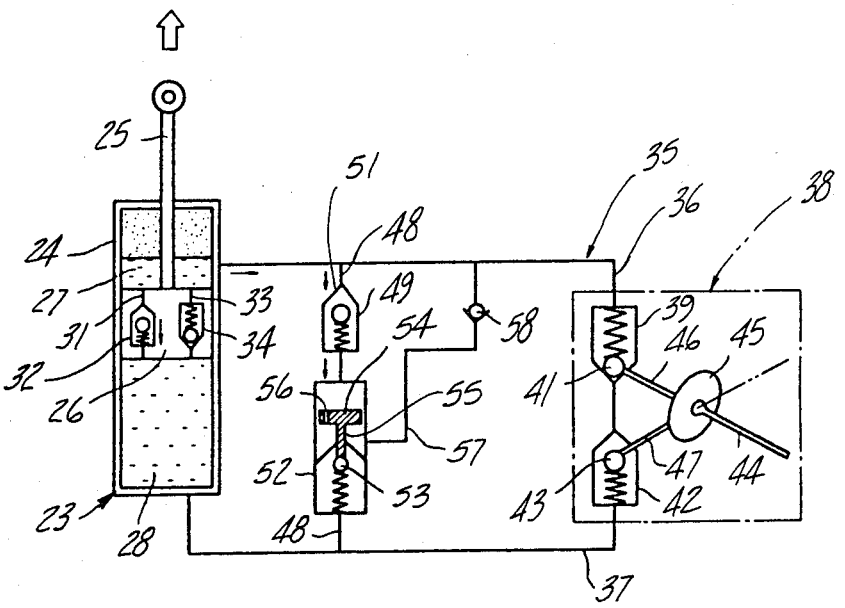

In the event the lower unit 15 strikes a submerged obstacle with sufficient force, there will be a pressure increase in the chamber 27 (FIG. 4). When this increased pressure condition is reached, the check valve 49 will open through movement of the ball 51 away from its seat. Pressure is then generated in the conduit 48 and acts upon the upper side of the piston 54 so as to drive the piston 54 downwardly and cause its piston rod 55 to engage the ball check valve 53 and unseat it. Fluid will then flow from the chamber 27 through the communication passageway 48 to the chamber 28 and the motor can pop up. Also, if sufficient pressure rise has occurred, the absorber valve 32 will become opened and permit flow from the chamber 28 to the chamber 28 to occur directly through the piston passage 31.

Figure 5:
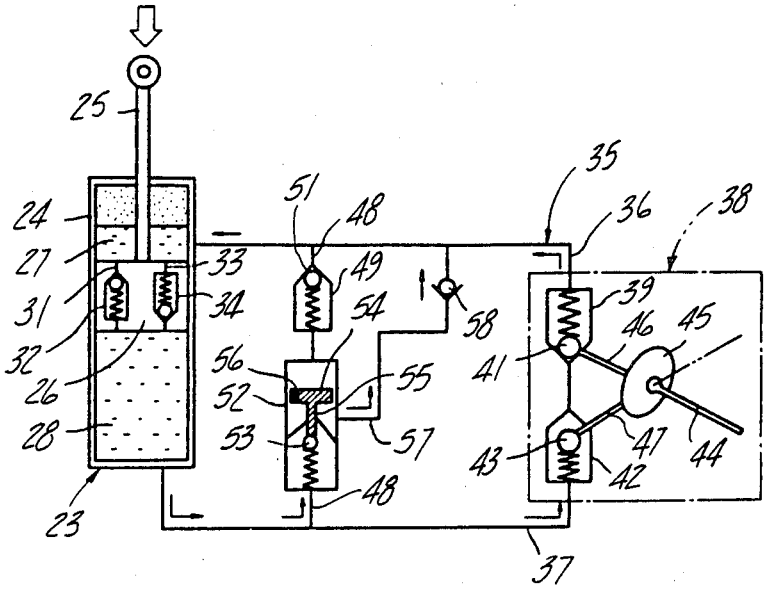

Once the obstacle is cleared, the weight of the motor 11 will act through the piston rod 25 onto the piston 26. This will cause an increase in pressure in the chamber 28 relative to the chamber 27 (FIG. 5). When this occurs, fluid may flow from the chamber 28 through the time delay valve 52 since the ball 53 will still be held in an opened position. The seating of the check valve 49 will cause a delay in the return movement of the piston 54 for a predetermined period of time due to the restriction of the orifice 56. The fluid which flows through the passageway 48 and past the ball check valve 53 is returned to the chamber 27 through the passageway 57 and check valve 58 which will open under this condition.

In addition to this return flow from the chamber 28 to the chamber 27, the pressure rise in the chamber 28 will cause the ball 41 of the check valve 39 of the manually operated directional control valve 38 to open so that reverse flow can also be achieved through the directional control valve 38. Thus, the motor will return to its normal running condition once the underwater obstacle is cleared.

When operating in reverse mode at the normal running condition of the motor, there will be a tendency for the pressure in the chamber 27 to rise due to the reverse thrust on the motor 11. However, the absorber valve 32 and check valve 49 are designed so that the pressure at which they open is less than the pressure generated in the chamber 27 during normal reverse operation. Hence, the motor 11 is prevented from tilting up by the operation of the valves 32 and 49 under the reverse running mode.

Figure 6:
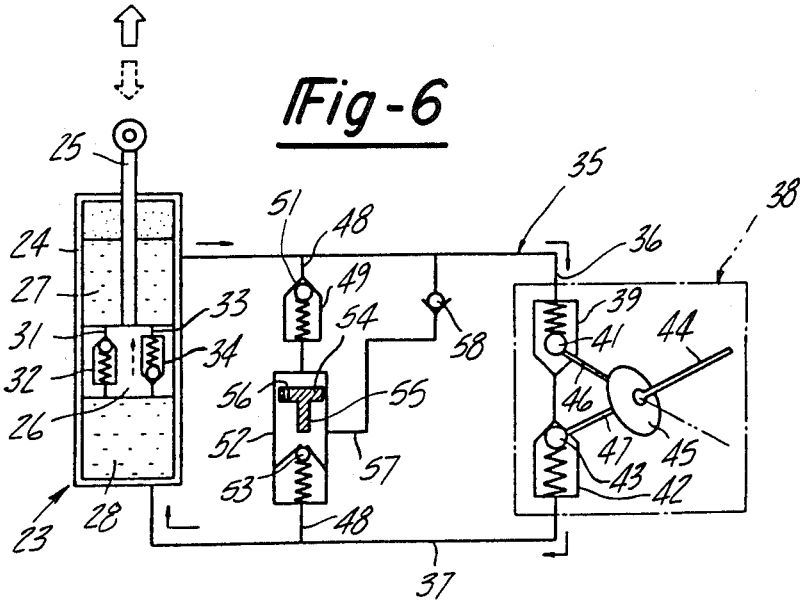

If it is desired to operate the motor 11 and boat 19 in shallow water, the manually operated directional control valve 38 is shifted over to a shallow water position through movement of the manually operated control 44. The control 44 is rotated so that the cam 45 will exert a force through the push rod 46 to unseat the ball 41 of the check valve 39 and so that the rod 47 will permit the ball 43 of the check valve 42 to become seated (FIG. 6). The motor 11 may then be raised by the operator without significant interference from the hydraulic system since fluid may flow from the chamber 27 through the directional control valve 38 to the chamber 28 when an operator lifts the motor.

When the desired position is reached and the operator releases the motor 11, it will be prevented from downward movement. That is, the weight of the motor acting on the piston 26 will tend to cause a rise in pressure in the chamber 28. However, the time delay valve 52 and check valve 42 will prevent any flow from the chamber 28 to the chamber 27 and the motor 11 will be maintained hydraulically in its shallow water condition. The relief valve 34 is set to open at a pressure that is greater than that generated by the weight of the motor 11 so that the motor will not move downwardly once it is released.

When operating in a forward direction with the motor 11 tilted up to its shallow water position, the forward force of the propeller 15 causes a pressure increase in the chamber 28. However, the time delay valve 52 and check valve assembly 42 of the directional control valve 38 will be in their closed position and there will be no flow through the bypass passage 35 from the chamber 28 to the chamber 27. Assuming the forward thrust does not exceed the pressure required to open the relief valve 34, the motor 11 will continue to be operated in its shallow water condition.

If, however, the thrust on the motor is increased by substantially increasing its speed, the relief valve 34 will open and the piston 26 may move downwardly with flow occurring from the chamber 28 to the chamber 27 through the relief passage 33 and the motor 11 will return to its normal running condition. Therefore, to return the motor to its normal running condition once the shallow water has been navigated, it is merely necessary for the operator to increase the speed of the motor and, accordingly, the thrust generated by it.

Considering again the condition when the motor is in its shallow water condition and it is driven rearwardly, the piston 26 will tend to move upwardly and cause an increase in pressure in the chamber 27. As long as this increased pressure does not exceed the pressure necessary to open the absorber valve 32 or check valve 49 or the check valve 42 of the directional control valve 38 to open, the motor will be held against tilting movement by the reverse thrust.

If excess thrust is generated in a reverse direction, the valves 42 and 49 may open as may the valve 32 so as to permit the motor to tilt up.

Figure 7:
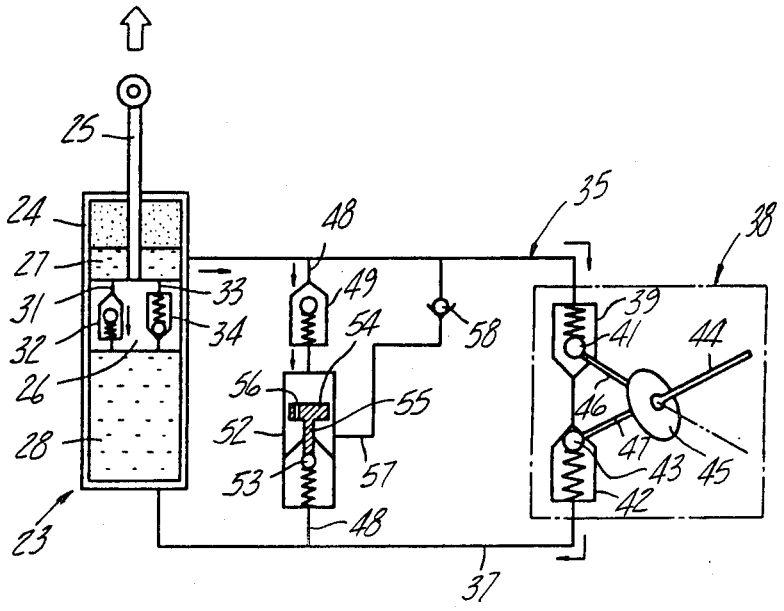
Figure 8:
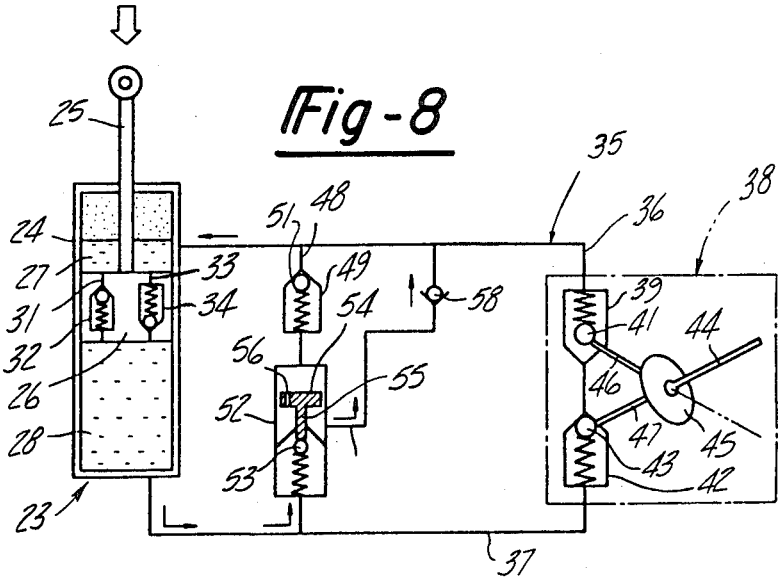

Considering now the condition when the motor is operating in its shallow water condition and an underwater obstacle is struck, the pressure in the chamber 71 will be raised (FIG. 7). When this occurs, the check valve 49 will open and actuate the time delay valve 52 so that it also will open. Flow is then permitted from the chamber 27 to the chamber 28. In addition to this flow, the check valve 42 of the manually operated directional control valve 38 will open so as to permit flow from the chamber 27 to the chamber 28 through the valve 38. Furthermore, the absorber valve 32 may also open under this condition so as to permit the popping up action.

Once the motor has cleared the obstruction under shallow water operation, the weight of the motor 11 acting on the piston 26 will cause a pressure rise to occur in the chamber 28. The time delay valve 52 will be maintained in an opened condition since the piston 54 will be retarded from its rearward movement by the restriction to flow through the orifice 56. Hence, fluid may flow from the chamber 28 through the time delay valve 52 and passage 57 to open the check valve 58 and return to the chamber 27. This reverse flow will occur for sufficient time so as to permit the motor to return to its shallow water operating condition.

As should be readily apparent, this construction permits the motor 11 to pop up under striking an obstacle either from the normal running condition or from the shallow water running condition. The popping up action under the shallow running condition does not provide as much damping in view of the fact that the check valve 39 is held open and, therefore, the absorber valve 32 does not influence as much control over the popping up action. This is acceptable, however, since the speed of travel when operating in the shallow water condition is relatively low.

EMBODIMENT OF FIGS. 9 THROUGH 11

Figure 11:
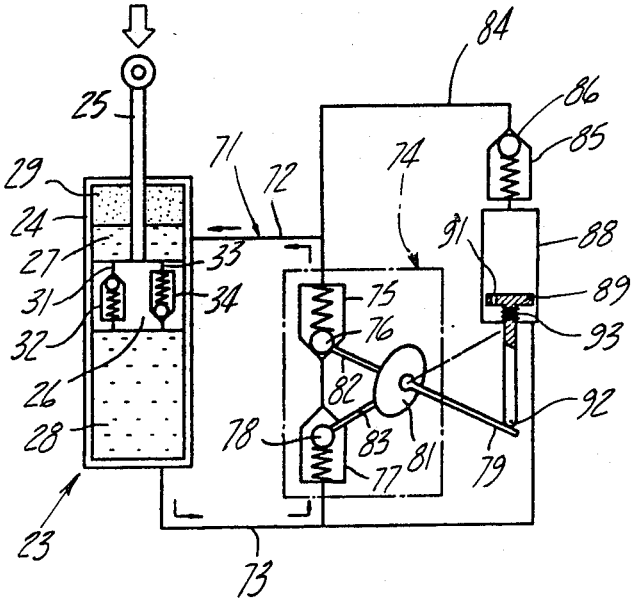

FIGS. 9 through 11 illustrate another embodiment of the invention that achieves substantially all of the same functions as the embodiment of FIGS. 3 through 8. This embodiment, however, employs a simplified hydraulic circuitry. Referring now to this embodiment, the piston and cylinder assembly are the same as the embodiment of FIGS. 3 through 8. Therefore, the elements of this portion of the construction have been identified by the same reference numerals and will not be described again in detail except insofar as is necessary to understand the construction and operation of this embodiment. The hydraulic device 23 is also interrelated with the motor 11 and watercraft 19 in any suitable manner, for example as described in conjunction with FIGS. 1 and 2.

In this embodiment, a bypass passageway, indicated generally by the reference numeral 71 including a pair of branch passages 72 and 73 extend between the chambers 27 and 28. A manually and automatically operated directional control valve, indicated generally by the reference numeral 74, is interposed in the bypass passageway 71 for selectively controlling the communication between the branch passages 72 and 73. The directional control valve 74, like the embodiment of FIGS. 3 through 8, includes a first check valve 75 having a spring biased ball 76 that is operative to prevent flow from the chamber 27 through the bypass passages 71 to the chamber 28. In a like manner, the valve 74 also includes a second check valve 77 having a spring biased ball 78 that is normally operative to preclude flow from the chamber 28 through the bypass passage 71 to the chamber 27.

A combined manually and automatically actuated operator 79 operates a cam 81 which, in turn, operates a pair of control rods 82 and 83. The control rod 82 is operative so as to manually displace the ball 76 of the check valve 76 to an opened condition. The rod 83 is adapted to operate the ball 78 of the check valve 77 so as to open this ball when the cam 81 is appropriately positioned.

A communicating passage 84 extends between the branch passages 72 and 73 in parallel relationship to the directional control valve 74. A check valve 85 is positioned in the communicating passage 84 and is disposed so that its control ball 86 is operative to permit flow from the chamber 27 to the chamber 28 through the communicating passage 84 while precluding reverse flow. The check valve 85 is designed to open at a lower pressure than the absorber valve 32.

A time delay control valve switching device, indicated generally by the reference numeral 87, is positioned in the communicating passageway 84 downstream of the check valve 85 for providing automatic operation of the directional control valve 74 and more particularly its operator 79. The device 87 includes a cylinder 88 in which a piston 89 is supported for reciprocation. The piston 89 is formed with a restricted orifice 91 that permits communication between the opposite sides of the piston. A rod 92 is affixed to the piston 89 and is adapted to engage the valve operator 79, as will become apparent. A coil compression spring 93 encircles the rod 92 and engages the piston 89 so as to normally urge it to the position shown in FIG. 9. The portion of the cylinder 88 on the downstream side of the piston 89 communicates with the passageway 84 and, accordingly, with the branch passageway 73.

During normal running operation with the motor set at its normal running trim, the directional control valve 74 is set so that its operator 79 is in the position as shown in FIG. 11. Hence, the check valve 75 will be permitted to operate in a normal manner and the check valve 77 will be held open. Therefore, the valve 74 is disposed so that there may be flow from the chamber 28 through the branch passage 73, valve 74 and branch passage 72 to the chamber 27. No flow is permitted, however, from the branch passage 72 through the valve 74 to the branch passage 73 and chamber 28. The check valve 75 will preclude such flow.

During the normal running condition and before there has been an impact, the check valve 85 will be closed and the piston assembly 87 will be held in the position shown in FIG. 9, by the spring 93. Incidentally, the spring 93 may be deleted if desired and the pressure on the underside of the piston 89 can be used as the sole force to restore the piston 89 to its normal condition.

Assuming that the boat is travelling forwardly and the motor 11 strikes a submerged obstacle, the pressure in the chamber 27 will rise sufficiently so as to unseat the check valve ball 86 and permit flow to occur from the chamber 27 through the branch passage 72 and branch passage 84. The pressure causes the piston 89 to move downwardly and opens flow back through the branch passage 84 to the branch passage 73 and chamber 28. Also, the absorber valve 32 may open if the impact is sufficient so as to permit the flow to occur from the chamber 27 directly through the piston 26 to the chamber 28. In this regard, the check valve 85 acts similar to the check valve 49 in the embodiment of FIGS. 3 through 8.

Once the underwater obstacle is cleared, the weight of the motor acting on the piston 26 will cause the pressure in the chamber 28 to rise. Since the check valve 77 is held open, the increased pressure can flow back through the valve 74 and branch passage 72 to the chamber 27 so that the motor can return to its normal state. The relief valve 34 will also open under this condition so as to permit direct flow back to the chamber 27 through the piston 26. The increased pressure in the chamber 28 can be used, as aforenoted, to return the piston 89 to its normal condition under the circumstances. Alternatively, the pressure and the spring 93 may act together so as to return the piston.

When operating in a reverse direction under normal motor trim, the pressure in the chamber 28 will tend to rise. However, the check valve 85 and absorber valve 32 are set to open at a pressure that is high enough so as to resist popping up under normal reverse operation.

Considering now the shallow trim operating condition, the motor 11 may be raised by an operator grasping the operator 79 and rotating the directional control valve 74 from the position shown in FIG. 11 to the position shown in FIG. 9. This movement of the associated cam 81 causes the check valve 77 to be moved to its closed, normally operative condition and will effect opening of the check valve 76. The directional control valve 74 is thus positioned so that flow will be permitted from the chamber 27 to the chamber 28 through the valve 74 if sufficient pressure differential exists while precluding flow in the reverse direction. Once the valve 74 is set in the shallow trim adjusting position is shown in FIG. 9, the motor 11 may be raised by the operator to the desired trim position. The pressure in the chamber 27 will rise during this tilting movement and cause the check valve 77 to open to permit flow to the chamber 78. Once the desired position is reached, the motor may be released and the check valves 77 and 85 as well as the pressure required to open the relief valve 33 will prevent the motor from lowering itself. That is, fluid will be trapped in the chamber 28 and the motor will be held in its shallow trim adjusted position.

When operating in the shallow trim condition and the motor 11 strikes a submerged underwater obstacle, the pressure in the chamber 27 will be raised due to the upward force on the piston 26 (FIG. 10). When the pressure thus rises, the check valve 77 will be opened and flow is permitted from the branch passage 72 through the control valve 74 to the branch passage 73 and chamber 28. At the same time, the increase pressure will cause the check valve 85 and specifically its ball 86 to open and cause pressure to be exerted on the upper side of the piston 89. This causes the piston 89 to move downwardly and act on the control valve operator 79 so as to rotate it toward its normal running condition. There will also be flow through the branch passage 84 from the chamber 27 to the chamber 28. In addition to these flows, the absorber valve 32 will open and permit direct flow from the chamber 27 to the chamber 28 through the bypass passage 31 in the piston 26.

Once the underwater obstacle is cleared, the weight of the motor 11 will act on the piston 26 through the piston rod 25 and cause a pressure increase to occur in the chamber 28. Since the check valve 77 is now held open by the downwardly displaced piston 89, flow may occur from the chamber 28 through the valve 74 back to the chamber 27 so as to permit the motor to lower. Also, the relief valve 34 may open under these circumstances so that the motor can return to its downward position. Since the changeover valve 74 has been shifted back to its normal running condition, the motor will return to the normal condition once the obstacle has cleared rather than its shallow water condition.

It should be readily apparent that two embodiments of the invention have been disclosed, each of which employs a simplified hydraulic arrangement for holding an outboard motor in either a normal running condition or a shallow running condition and which permits the motor to pop up when an underwater obstacle is struck and return to its normal position. In one embodiment, the motor returns to its shallow water position when it is popped up from the shallow water position. The hydraulic control arrangement associated with each device is relatively simple and also permits the motor to be easily raised from the normal condition to a shallow water position without interference from the hydraulic system. Although two embodiments have been disclosed, various changes and modifications may be made without departing from the spirit and scope of the inventiom, as defined by the appended claims.

We claim:

1. In a tilt locking and shock absorbing arrangement for a marine outboard trim comprising a drive member supported for tilting movement relative to a hull of an associated watercraft about a substantially horizontally disposed tilt axis, a hydraulic assembly comprising a cylinder and a piston slidably supported in said cylinder and defining first and second chambers, means for operatively interposing said hydraulic assembly between said hull and said drive member for relative movement of said piston and said cylinder upon tilting movement of said drive member about said tilt axis, a first passage including pressure responsive absorber valve means for permitting flow from said first chamber to said second chamber upon the application of a predetermined force tending to cause said drive member to tilt up about said tilt axis, and a second passage including pressure responsive relief valve means for permitting flow from said second chamber to said first chamber upon the exertion of a predetermined force to effect tilt down of said drive member, the improvement comprising means for controlling the movement of said drive member about said tilt axis comprising a third passage extending between said first and second chambers, first check valve means in said third passage including a check valve element normally biased to a closed position and opened in response to fluid pressure on said valve element for permitting flow from said first chamber to said second chamber and for precluding flow from said second chamber to said first chamber through said third passage, second check valve means in said third passage including a check valve element normally biased to a closed position and opened in response to fluid pressure on said valve element for permitting flow from said second chamber to said first chamber and for precluding flow from said first chamber to said second chamber through said third passage, and control means for selectively opening one of said check valve means so that the other of said check valve means will control the direction of flow through said third passage.

2. In a tilt locking and shock absorbing aarrangement as set forth in claim 1 wherein the first passage and the second passage are formed in said piston and the pressure responsive absorber valve means and the pressure responsive relief valve means are carried by said piston.

3. In a tilt locking and shock absorbing arrangement as set forth in claim 2 wherein the pressure responsive relief valve means opens at a pressure greater than the pressure generated by the weight of the drive member for retaining the drive member in a tilted up position.

4. In a tilt locking and shock absorbing arrangement as set forth in claim 1 wherein the control means includes a single manually operable means for selectively opening both of the check valve means.

5. In a tilt locking and shock absorbing arrangement as set forth in claim 4 wherein the single manually operable means is operative to maintain a selected one of the check valve means in its open position and for permitting normal check valve operation of the other of the check valve means.

6. In a tilt locking and shock absorbing arrangement as set forth in claim 1 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

7. In a tilt locking and shock absorbing arrangement as set forth in claim 6 further including means for moving said control means from its second position to its first position upon the rise of pressure in one of the chambers to an extent greater than a predetermined amount.

8. In a tilt locking and shock absorbing arrangement as set forth in claim 7 wherein the means for moving the control means comprises a piston responsive to the pressure in the one chamber.

9. In a tilt locking and shock absorbing arrangement for a marine outboard drive comprising a drive member supported for tilting movement relative to a hull of an associated watercraft about a substantially horizontally disposed tilt axis, a hydraulic assembly comprising a cylinder and a piston slidably supported in said cylinder and defining first and second chambers, means for operatively interposing said hydraulic assembly between said hull and said drive member for relative movement of said piston and said cylinder upon tilting movement of said drive member about said tilt axis, damping means for permitting flow from said first chamber to said second chamber upon the application of a predetermined force tending to cause said drive member to tilt up about said tilt axis and for permitting flow from said second chamber to said first chamber upon the exertion of a predetermined force to effect tilt down of said drive member, the improvement comprising means for controlling movement of said drive member about said tilt axis comprising passage means extending between said first and second chambers, first check valve means in said passage means including a check valve element normally biased to a closed position and opened in response to fluid pressure on said valve element for permitting flow from said first chamber to said second chamber and for precluding flow from said second chamber to said first chamber, second check valve means in said passage means including a check valve element normally biased to a closed position and opened in response to fluid pressure on said valve element for permitting flow from said second chamber to said first chamber and for precluding flow from said first chamber to said second chamber, and control means for selectively opening one of said check valve means so that the other of said check valve means controls the flow through said passage means.

10. In a tilt locking and shock absorbing arrangement as set forth in claim 9 wherein the control means includes a single manually operable means for selectively opening each of the check valve means.

11. In a tilt locking and shock absorbing arrangement as set forth in claim 10 wherein the single manually operable means is operative to maintain a selected one of the check valve means in its open position and for permitting normal check valve operation of the other of the check valve means.

12. In a tilt locking and shock absorbing arrangement as set forth in claim 9 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

13. In a tilt locking and shock absorbing arrangement as set forth in claim 12 further including means for moving said control means from its second position to its first position upon the rise of pressure in one of the chambers to an extent greater than a predetermined amount.

14. In a tilt locking and shock absorbing arrangement as set forth in claim 13 wherein the means for moving the control means comprises a piston responsive to the pressure in the one chamber.

15. A hydraulic system comprising a piston and cylinder assembly defining a first and a second fluid chamber and means for controlling the flow between said chambers upon relative movement between said piston and said cylinder comprising passage means for communicating said chambers with each other, valve means comprising a first check valve including a check valve element normally biased to a closed position and opened in response to fluid pressure on said valve element for selectively permitting flow only from said first chamber to said second chamber and for precluding flow from said second chamber to said first chamber through said passage means and a second check valve including a check valve element normally biased to a closed position and opened in response to fluid pressure on said valve element for permitting flow only from said second chamber to said first chamber and for precluding flow from said first chamber to said second chamber through said passage means, and means responsive to a predetermined pressure in said first chamber for operating said valve means so that said valve means is positioned to first permit flow from said first chamber to said second chamber for a predetermined period of time and then to permit flow from said second chamber to said first chamber.

16. A hydraulic system as set forth in claim 15 wherein the means responsive to the predetermined pressure is effective to move the first check valve from a held open position to a position wherein the first check valve is allowed to normally operate and for moving the second check valve from a normally operative position to a held open condition in response to the exertion of the predetermined pressure.

* * * * *